US005859621A

United States Patent [19]

Leisten

[11] Patent Number: 5,859,621

[45] Date of Patent: Jan. 12, 1999

[54] ANTENNA

[75] Inventor: Oliver Paul Leisten, Kingsthorpe, England

[73] Assignee: SymmetriCom, Inc., San Jose, Calif.

[21] Appl. No.: 804,209

[22] Filed: Feb. 21, 1997

[30] Foreign Application Priority Data

Feb. 23, 1996 [GB] United Kingdom ..... 9603914

[51] Int. Cl.[6] ..... H01Q 1/36

[52] U.S. Cl. ..... 343/895; 343/821; 343/859

[58] Field of Search ..... 343/700 MS, 702, 343/821, 850, 853, 859, 860, 895, 865; 29/600, 601; H01Q 1/24, 1/36, 1/38, 11/08, 21/20

[56] References Cited

U.S. PATENT DOCUMENTS

| | | | |
|---|---|---|---|
| 2,575,377 | 11/1951 | Wohl . | |
| 2,763,003 | 9/1956 | Harris . | |
| 3,633,210 | 1/1972 | Westerman . | |
| 3,906,509 | 9/1975 | DuHammel . | |
| 3,940,772 | 2/1976 | Ben-dov | 343/895 |
| 4,008,479 | 2/1977 | Smith . | |
| 4,114,164 | 9/1978 | Greiser | 343/895 |
| 4,160,979 | 7/1979 | Drewett . | |
| 4,204,212 | 5/1980 | Sindoris et al. . | |
| 4,270,128 | 5/1981 | Drewett . | |
| 4,323,900 | 4/1982 | Krall et al. . | |
| 4,349,824 | 9/1982 | Harris . | |
| 4,608,572 | 8/1986 | Blakney et al. | 343/895 |
| 4,608,574 | 8/1986 | Webster et al. . | |
| 4,697,192 | 9/1987 | Hofer et al. | 343/895 |
| 4,862,184 | 8/1989 | Ploussios . | |
| 4,940,992 | 7/1990 | Nguyen et al. . | |
| 4,980,694 | 12/1990 | Hines . | |
| 5,081,469 | 1/1992 | Bones . | |
| 5,099,249 | 3/1992 | Seavey . | |
| 5,134,422 | 7/1992 | Auriol . | |
| 5,255,005 | 10/1993 | Terret et al. . | |
| 5,258,728 | 11/1993 | Taniyoshi et al. . | |
| 5,298,910 | 3/1994 | Takei et al. . | |
| 5,329,287 | 7/1994 | Strickland . | |
| 5,341,149 | 8/1994 | Valimaa et al. . | |
| 5,345,248 | 9/1994 | Hwang et al. . | |
| 5,346,300 | 9/1994 | Yamamoto et al. . | |
| 5,349,361 | 9/1994 | Egashira et al. . | |
| 5,349,365 | 9/1994 | Ow et al. . | |
| 5,406,296 | 4/1995 | Egashira et al. . | |
| 5,406,693 | 4/1995 | Egashira et al. . | |
| 5,450,093 | 9/1995 | Kim . | |
| 5,479,180 | 12/1995 | Lenzing et al. . | |

FOREIGN PATENT DOCUMENTS

| | | |
|---|---|---|
| 0051018 | 5/1982 | European Pat. Off. . |
| 0429255 | 11/1990 | European Pat. Off. . |

(List continued on next page.)

OTHER PUBLICATIONS

Krall, McCorkel, Scarzello, Syeles, Communications, IEEE Transactions on Antennas and Propagation, vol. AP–27, No. 6, Nov., 1979.

Casey, Square Helical Antenna with a Dielectric Core, IEEE Transactions on Electromagnetic Compatibility, vol. 30, No. 4, Nov. 1988.

Search Report for Gt. Britain Application No. GB 9606593.3, dated 25 Jun. 1995.

*Primary Examiner*—Hoanganh T. Le
*Assistant Examiner*—Tho Phan
*Attorney, Agent, or Firm*—Mark A. Haynes; Wilson, Sonsini, Goodrich & Rosati

[57] ABSTRACT

An antenna for use at frequencies of 200 MHz and upwards has a cylindrical ceramic core with a relative dielectric constant of at least 5, and pairs of helical elements extending from a feed point at one end of the core to the rim of a conductive sleeve adjacent the other end of the core, the sleeve acting as a trap for isolating from ground currents circulating in the helical elements. To yield helical elements of different lengths, the sleeve rim follows a locus which deviates from a plane perpendicular to the core axis in that it describes a zig-zag path. The helical elements form simple helices with approximately balanced radiation resistances.

13 Claims, 1 Drawing Sheet

FOREIGN PATENT DOCUMENTS

| | | | |
|---|---|---|---|
| 0465658 | 1/1992 | European Pat. Off. . | |
| 0521511 | 1/1993 | European Pat. Off. . | |
| 0320404 | 3/1993 | European Pat. Off. . | |
| 0588465 | 3/1994 | European Pat. Off. . | |
| 0590534 | 4/1994 | European Pat. Off. . | |
| 2603-743 | 3/1988 | France | H01Q 11/08 |
| 5588408 | 7/1990 | Japan . | |
| 3-274904 | 12/1991 | Japan | H01Q 11/08 |
| 7-249973 | 6/1995 | Japan . | |
| 1483-511 | 5/1989 | U.S.S.R. | H01Q 11/08 |
| 762415 | 11/1956 | United Kingdom . | |
| 840850 | 7/1960 | United Kingdom . | |
| 1198410 | 7/1970 | United Kingdom . | |
| 1568436 | 5/1980 | United Kingdom . | |
| 2202380 | 9/1988 | United Kingdom . | |
| 2196483 | 3/1990 | United Kingdom . | |
| 2246910 | 2/1992 | United Kingdom . | |
| 2292257 | 2/1996 | United Kingdom . | |
| 2292638 | 2/1996 | United Kingdom . | |
| 9111038 | 7/1991 | WIPO . | |
| 9205602 | 4/1992 | WIPO . | |
| 9217915 | 10/1992 | WIPO . | |
| 9322804 | 4/1993 | WIPO . | |
| 9427338 | 5/1994 | WIPO . | |

ANTENNA

FIELD OF THE INVENTION

This invention relates to an antenna for operation at frequencies in excess of 200 MHz, and particularly but not exclusively to an antenna having helical elements on or adjacent the surface of a dielectric core for receiving circularly polarised signal. Such signals are transmitted by satellites of the Global Positioning System (GPS).

BACKGROUND OF THE INVENTION

Such an antenna is disclosed in our co-pending British Patent Application No. 9517086.6, the entire disclosure of which is incorporated in this present application so as to form part of the subject matter of this application as first filed. The earlier application discloses a quadrifilar antenna having two pairs of diametrically opposed helical antenna elements, the elements of the second pair following respective meandered paths which deviate on either side of a mean helical line on an outer cylindrical surface of the core so that the elements of the second pair are longer than those of the first pair which follow helical paths without deviation. Such variation in the element lengths makes the antenna suitable for transmission or reception of circularly polarised signals.

The applicants have found that such an antenna tends to favour reception of elliptically rather than circularly polarised signals, and it is an object of the present invention to provide for enhanced reception of circularly polarised signals.

SUMMARY OF THE INVENTION

According to this invention, an antenna for operation at frequencies in excess of 200 MHz comprises a substantially cylindrical electrically insulative core of a material having a relative dielectric constant greater than 5, with the material of the core occupying the major part of the volume defined by the core outer surface, a feeder structure extending axially through the core, a trap in the form of a conductive sleeve encircling part of the core and having a ground connection at one edge, and first and second pairs of antenna elements each connected at one end to the feeder structure and at the other end to a linking edge of the sleeve, the antenna elements of the second pair being longer than those of the first pair, wherein the antenna elements of both pairs follow respective longitudinally extending paths, and the said linking edge follows a non-planar path around the core, the antenna elements of the first pair being joined to the linking edge at points which are nearer to the connections of the elements to the feeder structure than are the points at which the antenna elements of the second pair are joined to the linking edge. The longitudinally extending paths are preferably helical paths, each element subtending the same angle of rotation at the core axis, e.g. 180° or a half turn. In this way it is possible to avoid deviations of the longer antenna elements from the respective helical paths, thereby yielding more balanced radiation resistances for the antenna elements and consequent improved performance with circularly polarised signals.

The core may be a cylindrical body which is solid with the exception of a narrow axial passage housing the feeder structure. Preferably, the volume of the solid material of the core is at least 50 percent of the internal volume of the envelope defined by the antenna elements and the sleeve, with the elements lying on an outer cylindrical surface of the core. The elements may comprise metallic conductor tracks bonded to the core outer surface, for example by deposition or by etching of a previously applied metallic coating.

For reasons of physical and electrical stability, the material of the core may be ceramic, e.g. a microwave ceramic material such as a zirconium-titanate-based material, magnesium calcium titanate, barium zirconium tantalate, and barium neodymium titanate, or a combination of these. The preferred relative dielectric constant is upwards of 10 or, indeed, 20, with a figure of 36 being attainable using zirconium-titanate-based material. Such materials have negligible dielectric loss to the extent that the Q of the antenna is governed more by the electrical resistance of the antenna elements than core loss.

A particularly preferred embodiment of the invention has a cylindrical core of solid material with an axial extent at least as great as its outer diameter, and with the diametrical extent of the solid material being at least 50 percent of the outer diameter. Thus, the core may be in the form of a tube having a comparatively narrow axial passage of a diameter at most half the overall diameter of the core. The inner passage may have a conductive lining which forms part of the feeder structure or a screen for the feeder structure, thereby closely defining the radial spacing between the feeder structure and the antenna elements. This helps to achieve good repeatability in manufacture. The helical antenna elements are preferably formed as metallic tracks on the outer surface of the core which are generally co-extensive in the axial direction. Each element is connected to the feeder structure at one of its ends and to the sleeve at its other end, the connections to the feeder structure being made with generally radial conductive elements, and the sleeve being common to all of the helical elements. The trap produces a virtual ground for the antenna elements at the linking edge. The radial elements may be disposed on a distal end surface of the core.

The preferred embodiment has antenna elements with an average electrical length of $\lambda/2$, but alternative embodiments are feasible having electrical lengths of e.g. $\lambda/4$, $3\lambda/4$, $\lambda$ and other multiples of $\lambda/4$, which produce modified radiation patterns.

Advantageously the helical elements extend proximally from the distal end of the core to the conductive sleeve which extends over part of the length of the core from a connection with the feeder structure at the proximal end of the core. In the case of the feeder structure comprising a coaxial line having an inner conductor and an outer screen conductor, the conductive sleeve is connected at the proximal end of the core to the feeder structure outer screen conductor.

Using the above-described features it is possible to make an antenna which is extremely robust due to its small size and due to the elements being supported on a solid core of rigid material. Such an antenna can be arranged to have a low-horizon omni-directional response with robustness sufficient for use as a replacement for patch antennas in certain applications. Its small size and robustness render it suitable also for unobtrusive vehicle mounting and for use in hand-held devices. It is possible in some circumstances even to mount it directly on a printed circuit board.

The longitudinal extent of the antenna elements, i.e. in the axial direction, is generally greater than the average axial length of the conductive sleeve. Typically the average axial length of the antenna element is twice that of the sleeve, and the diameters of the elements and the sleeve are the same and in the range of from 0.15 to 0.25 times the combined length of the antenna elements and the sleeve. Preferably, the average axial length of the sleeve is not less than 0.35 times the average axial length of the antenna elements. The difference in axial length between the antenna elements of the first pair and those of the second pair is generally less than one half of their average length and preferably in the range of from 0.05 to 0.15 times their average length.

The antenna may be manufactured by forming the antenna core from the dielectric material, and metallising the external surfaces of the core according to a predetermined pattern. Such metallisation may include coating external surfaces of the core with a metallic material and then removing portions of the coating to leave the predetermined pattern, or alternatively a mask may be formed containing a negative of the predetermined pattern, and the metallic material is then deposited on the external surfaces of the core while using the mask to mask portions of the core so that the metallic material is applied according to the pattern. Other methods of depositing a conductive pattern of the required form can be used.

A particularly advantageous method of producing an antenna having a trap or balun sleeve and a plurality of antenna elements forming part of a radiating element structure, comprises the steps of providing a batch of the dielectric material, making from the batch at least one test antenna core, and then forming a balun structure, preferably without any radiating element structure, by metallising on the core a balun sleeve having a predetermined nominal dimension which affects the frequency of resonance of the balun structure. The resonant frequency of this test resonator is then measured and the measured frequency is used to derive an adjusted value of the balun sleeve dimension for obtaining a required balun structure resonant frequency. The same measured frequency can be used to derive at least one dimension for the helical antenna elements to give a required antenna elements frequency characteristic. Antennas manufactured from the same batch of material are then produced with a sleeve and antenna elements having the derived dimensions.

DETAILED DESCRIPTION OF THE PREFERRED EMBODIMENT

Figure 1:
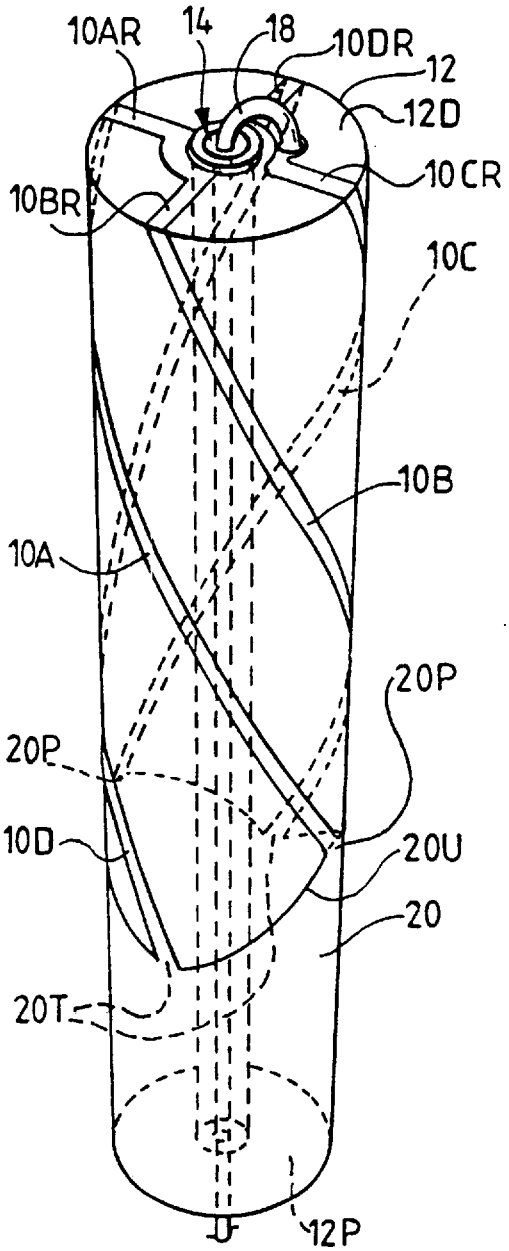
FIG. 1 is a perspective view of an antenna in accordance with the invention.

Referring to the drawings, a quadrifilar antenna in accordance with the invention has an antenna element structure with four longitudinally extending antenna elements 10A, 10B, 10C, and 10D formed as metallic conductor tracks on the cylindrical outer surface of a ceramic core 12. The core has an axial passage 14 with an inner metallic lining 16, and the passage houses an axial feeder conductor 18. The inner conductor 18 and the lining 16 in this case form a feeder structure for connecting a feed line to the antenna elements 10A–10D. The antenna element structure also includes corresponding radial antenna elements 10AR, 10BR, 10CR, 10DR formed as metallic tracks on a distal end face 12D of the core 12 connecting ends of the respective longitudinally extending elements 10A–10D to the feeder structure. The other ends of the antenna elements 10A–10D are connected to a common virtual ground conductor 20 in the form of a plated sleeve surrounding a proximal end portion of the core 12. This sleeve 20 is in turn connected to the lining 16 of the axial passage 14 by plating 22 on the proximal end face 12P of the core 12.

As will be seen from FIG. 1, the four longitudinally extending elements 10A–10D are of different lengths, two of the elements 10B, 10D being longer than the other two 10A, 10C by virtue of extending nearer the proximal end of the core 12. The elements of each pair 10A, 10C; 10B, 10D are diametrically opposite each other on opposite sides of the core axis.

In order to maintain approximately uniform radiation resistance for the helical elements 10A–10D, each element follows a simple helical path. Since each of the elements 10A–10D subtends the same angle of rotation at the core axis, here 180° or a half turn, the screw pitch of the long elements 10B, 10D is steeper than that of the short elements 10A, 10C. The upper linking edge 20U of the sleeve 20 is of varying height (i.e. varying distance from the proximal end face 12P) to provide points of connection for the long and short elements respectively. Thus, in this embodiment, the linking edge 2GU follows a zig-zag path around the core 12, having two peaks 20P and two troughs 20T where it meets the short elements 10A, 10C and long elements 10B, 10D respectively.

Each pair of longitudinally extending and corresponding radial elements (for example 10A, 10AR) constitutes a conductor having a predetermined electrical length. In the present embodiment, it is arranged that the total length of each of the element pairs 10A, 10AR; 10C, 10CR having the shorter length corresponds to a transmission delay of approximately 135° at the operating wavelength, whereas each of the element pairs 10B, 10BR; 10D, 10DR produce a longer delay, corresponding to substantially 225°. Thus, the average transmission delay is 180°, equivalent to an electrical length of $\lambda/2$ at the operating wavelength. The differing lengths produce the required phase shift conditions for a quadrifilar helix antenna for circularly polarised signals specified in Kilgus, "Resonant Quadrifilar Helix Design", The Microwave Journal, Dec. 1970, pages 49–54. Two of the element pairs 10C, 10CR; 10D, 10DR (i.e. one long element pair and one short element pair) are connected at the inner ends of the radial elements 10CR, 10DR to the inner conductor 18 of the feeder structure at the distal end of the core 12, while the radial elements of the other two element pairs 10A, 10AR; 10B, 10BR are connected to the feeder screen formed by metallic lining 16. At the distal end of the feeder structure, the signals present on the inner conductor 18 and the feeder screen 16 are approximately balanced so that the antenna elements are connected to an approximately balanced source or load, as will be explained below.

With the left handed sense of the helical paths of the longitudinally extending elements 10A–10D, the antenna has its highest gain for right hand circularly polarised signals.

If the antenna is to be used instead for left hand circularly polarised signals, the direction of the helices is reversed and the pattern of connection of the radial elements is rotated through 90°. In the case of an antenna suitable for receiving both left hand and right hand circularly polarised signals, the longitudinally extending elements can be arranged to follow paths which are generally parallel to the axis.

Figure 2:
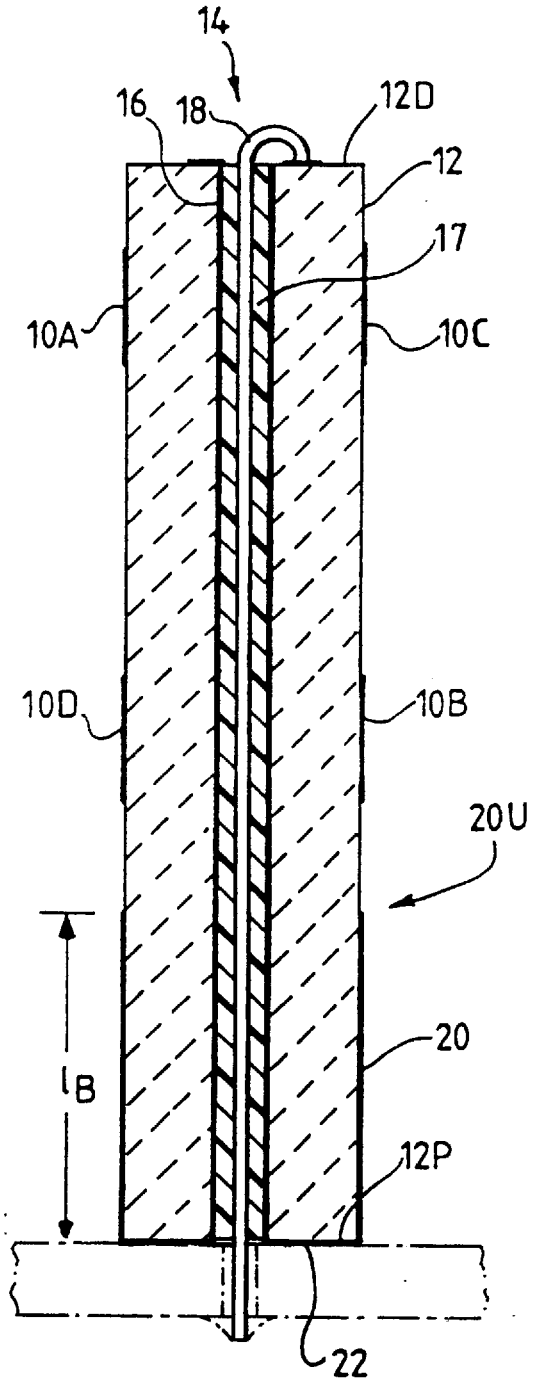
FIG. 2 is a diagrammatic axial cross-section of the antenna.

The conductive sleeve 20 covers a proximal portion of the antenna core 12, thereby surrounding the feeder structure 16, 18, with the material of the core 12 filling the whole of the space between the sleeve 20 and the metallic lining 16 of the axial passage 14. The sleeve 20 forms a cylinder having an average axial length $l_B$ as show in FIG. 2 and is connected to the lining 16 by the plating 22 of the proximal end face 12P of the core 12. The combination of the sleeve 20 and plating 22 forms a balun so that signals in the transmission line formed by the feeder structure 16, 18 are converted between an unbalanced state at the proximal end of the antenna and an approximately balanced state at an axial position generally at the same distance from the proximal end as the upper linking edge 20U of the sleeve 20. To achieve this effect, the average sleeve length $l_B$ is such that, in the presence of an underlying core material of relatively high relative dielectric constant, the balun has an average electrical length of $\lambda/4$ at the operating frequency of the antenna. Since the core material of the antenna has a foreshortening effect, and the annular space surrounding the inner conductor 18 is filled with an insulating dielectric material 17 having a relatively small dielectric constant, the feeder structure distally of the sleeve 20 has a short electrical length. Consequently, signals at the distal end of the feeder structure 16, 18 are at least approximately balanced. (The dielectric constant of the insulation in a semi-rigid cable is typically much lower than that of the ceramic core material referred to above. For example, the relative dielectric constant $\epsilon_r$ of PTFE is about 2.2.)

The applicants have found that the variation in length of the sleeve 20 from the mean electrical length of $\lambda/4$ has a comparatively insignificant effect on the performance of the antenna. The trap formed by the sleeve 20 provides an annular path along the linking edge 20U for currents between the elements 10A–10D, effectively forming two loops, the first with short elements 10A, 10C and the second with the long elements 10B, 10D. At quadrifilar resonance current maxima exist at the ends of the elements 10A–10D and in the linking edge 20U, and voltage maxima at a level approximately midway between the edge 20U and the distal end of the antenna. The edge 20U is effectively isolated from the ground connector at its proximal edge due to the approximate quarter wavelength trap produced by the sleeve 20.

The antenna has a main resonant frequency of 500 MHz or greater, the resonant frequency being determined by the effective electrical lengths of the antenna elements and, to a lesser degree, by their width. The lengths of the elements, for a given frequency of resonance, are also dependent on the relative dielectric constant of the core material, the dimensions of the antenna being substantially reduced with respect to an air-cored similarly constructed antenna.

The preferred material for the core 12 is zirconium-titanate-based material. This material has the above-mentioned relative dielectric constant of 36 and is noted also for its dimensional and electrical stability with varying temperature. Dielectric loss is negligible. The core may be produced by extrusion or pressing.

The antenna elements 10A–10D, 10AR–10DR are metallic conductor tracks bonded to the outer cylindrical and end surfaces of the core 12, each track being of a width at least four times its thickness over its operative length. The tracks may be formed by initially plating the surfaces of the core 12 with a metallic layer and then selectively etching away the layer to expose the core according to a pattern applied in a photographic layer similar to that used for etching printed circuit boards. Alternatively, the metallic material may be applied by selective deposition or by printing techniques. In all cases, the formation of the tracks as an integral layer on the outside of a dimensionally stable core leads to an antenna having dimensionally stable antenna elements.

With a core material having a substantially higher relative dielectric constant than that of air, e.g. $\epsilon_r$=36, an antenna as described above for L-band GPS reception at 1575 MHz typically has a core diameter of about 5 mm and the longitudinally extending antenna elements 10A–10D have an average longitudinal extent (i.e. parallel to the central axis) about 16 mm. The long elements 10B, 10D are about 1.5 mm longer than the short elements 10A, 10C. The width of the elements 10A–10D is about 0.3 mm At 1575 MHz, the length of the sleeve 22 is typically in the region of 8 mm. Precise dimensions of the antenna elements 10A–10D can be determined in the design stage on a trial and error basis by undertaking eigenvalue delay measurements until the required phase difference is obtained.

The manner in which the antenna is manufactured is described in the above-mentioned copending application No. 9517086.6 published as GB2292638A on Feb. 28, 1996, and described in U.S. patent application Ser. No. 08/351,631, filed Dec. 6, 1994 at pages 12 through 16 and 18 through 19 which are incorporated by reference. Alternatively, the methods of manufacture disclosed in U.S. patent application Ser. No. 08/707,947 filed Sep. 10, 1996, at pages 8 through 12 of which are incorporated by reference may also be used.

What is claimed is:

1. An antenna for operation at frequencies in excess of 200 MHz, comprising a substantially cylindrical electrically insulative core of a material having a relative dielectric constant greater than 5, with the material of the core occupying the major part of the volume defined by the core outer surface, a feeder structure extending axially through the core, a trap in the form of a conductive sleeve encircling part of the core and having a ground connection at one edge, and first and second pairs of antenna elements each connected at one end to the feeder structure and at the other end to a linking edge of the sleeve, the antenna elements of the second pair being longer than those of the first pair, wherein the antenna elements of both pairs follow respective longitudinally extending paths, and the said linking edge follows a non-planar path around the core, the antenna elements of the first pair being joined to the linking edge at points which are nearer to the connections of the elements to the feeder structure than are the points at which the antenna elements of the second pair are joined to the linking edge.

2. An antenna according to claim 1, wherein each of the longitudinally extending antenna element follows a respective helical path around the axis of the core, and the angle subtended by the two respective ends of each said antenna element at the core axis is the same in each case.

3. An antenna according to claim 2, wherein each of the said elements executes a half turn around the core axis, the connections between the elements and the feeder structure lying in a common plane perpendicular to the core axis, and wherein the screw pitch of the elements of the first pair is different from that of the elements of the second pair.

4. An antenna according to claim 1, wherein the linking edge of the trap follows a zig-zag path around the core with the elements of the first and second pair being joined at peaks and troughs respectively of the linking edge.

5. An antenna according to claim 1, wherein the ground connection edge of the trap lies in a plane perpendicular to the core axis and the average axial length of the sleeve forming the trap is at least approximately $\lambda/4$, where $\lambda$ is the operating wavelength at the interface between air and the dielectric material of the core.

6. An antenna according to claim 1, which is quadrifilar, having a single first pair and a single second pair of antenna elements.

7. An antenna according to claim 1, wherein the trap and the antenna elements are integrally formed on the cylindrical outer surface of the core.

8. An antenna according to claim 1, wherein the antenna elements of the first and second pairs are connected to the feeder structure by respective radial elements on a planar end surface of the core, and wherein the ground connection of the trap is formed by a conductive layer formed on the other end surface of the core.

9. An antenna according to claim 8, wherein the feeder structure is a coaxial transmission line, each of the said antenna element pairs having one element connected to an inner conductor of the feeder structure and one element connected to an outer conductor of the feeder structure, and wherein the outer conductor is joined to the said conductive layer.

10. An antenna according to claim 1, wherein the average axial length of the antenna elements is greater than the average axial length of the conductive sleeve.

11. An antenna according to claim 10, wherein the average axial length of the antenna element is, at least approximately, twice the average axial length of the sleeve, and the diameter of the elements and the diameter of the sleeve are the same and in the range of from 0.15 to 0.25 times the combined length of the antenna elements and the sleeve.

12. An antenna according to claim 10, wherein the ratio of the average axial length of the antenna elements to the average axial length of the sleeve is less than or equal to 1:0.35.

13. An antenna according to claim 1, wherein the difference in axial length between the antenna elements of the first pair and those of the second pair is less than one half of their average length.

* * * * *